US007820969B2

(12) United States Patent
Guinn et al.

(10) Patent No.: US 7,820,969 B2
(45) Date of Patent: Oct. 26, 2010

(54) TARGET WITH THERMAL IMAGING SYSTEM

(76) Inventors: Charlie Grady Guinn, 487 Scott Crossing Rd., Lewistown, MT (US) 59457; Edward Donald Schoppman, 5503 Effieham St., Oak Ridge, NC (US) 27310

( * ) Notice: Subject to any disclaimer, the term of this patent is extended or adjusted under 35 U.S.C. 154(b) by 52 days.

(21) Appl. No.: 12/467,780

(22) Filed: May 18, 2009

(65) Prior Publication Data

US 2009/0283678 A1 Nov. 19, 2009

Related U.S. Application Data

(63) Continuation-in-part of application No. 12/052,792, filed on Mar. 21, 2008, now Pat. No. 7,667,213.

(51) Int. Cl.
*G02F 1/00* (2006.01)

(52) U.S. Cl. ..... 250/330; 250/495.1; 250/504 R; 273/348.1

(58) Field of Classification Search ..... 250/330, 250/332, 495.1, 504 R; 273/348, 348.1, 273/408

See application file for complete search history.

(56) References Cited

U.S. PATENT DOCUMENTS

| | | | | |
|---|---|---|---|---|
| 4,240,212 | A | 12/1980 | Marshall et al. | |
| 4,260,160 | A | 4/1981 | Ejnell et al. | |
| 4,346,901 | A | 8/1982 | Booth | |
| 4,405,132 | A | 9/1983 | Thalmann | |
| 4,422,646 | A | 12/1983 | Rosa | |
| 4,546,983 | A | 10/1985 | Rosa | |
| 4,659,089 | A | 4/1987 | Rosa | |
| 4,792,142 | A | 12/1988 | Davies | |
| 5,065,032 | A | 11/1991 | Prosser | |
| 5,066,019 | A | 11/1991 | Dean et al. | |
| 5,296,270 | A | 3/1994 | Prosser | |
| 5,319,213 | A | 6/1994 | Watkins et al. | |
| 5,901,959 | A | 5/1999 | Tessiot | |
| 5,969,369 | A | 10/1999 | Fogarty | |
| 6,315,294 | B1 | 11/2001 | Belleville | |
| 6,337,475 | B1 | 1/2002 | Miglirini | |
| 6,767,015 | B1 | 7/2004 | Parsley | |
| 6,768,126 | B2 * | 7/2004 | Novak et al. | 250/504 R |
| 6,806,480 | B2 | 10/2004 | Reshef | |
| 7,377,517 | B2 | 5/2008 | Andren et al. | |
| 2007/0013137 | A1 | 1/2007 | Andren et al. | |
| 2007/0205560 | A1 | 9/2007 | Hebble | |
| 2008/0169609 | A1 | 7/2008 | Hetland | |
| 2008/0296842 | A1 | 12/2008 | Novak et al. | |

* cited by examiner

*Primary Examiner*—David P Porta
*Assistant Examiner*—Marcus H Taningco
(74) *Attorney, Agent, or Firm*—Antoinette M. Tease

(57) ABSTRACT

A target with a thermal imaging system comprising a layer of corrugated plastic, a layer of bifurcated metallic foil, a layer of clear plastic, a wire grid, two strips of carbon tape, a front cover sheet, and a power lead. The layer of bifurcated metallic foil is situated on top of the layer of corrugated plastic. The layer of clear plastic is situated on top of the layer of bifurcated metallic foil. The wire grid is situated on top of the layer of clear plastic. One strip of carbon tape is adhered to the right side of the wire grid, and the other strip of carbon tape is adhered to the left side of the wire grid. The power lead is connected to the carbon tape. The front cover sheet is adhered to the target so that it covers the wire grid and carbon tape.

16 Claims, 8 Drawing Sheets

TARGET WITH THERMAL IMAGING SYSTEM

CROSS-REFERENCE TO RELATED APPLICATION

This application is a continuation-in-part of U.S. patent application Ser. No. 12/052,792 filed on Mar. 21, 2008. The contents of that application are incorporated herein by reference.

BACKGROUND OF THE INVENTION

1. Field of the Invention

The present invention relates generally to the field of targets, and more specifically, to a human target constructed with a thermal imaging system.

2. Description of the Related Art

Infrared and other thermal-related detection devices have become increasingly important, particularly in combat. This technology has not been effectively deployed, however, for the purpose of assisting soldiers in distinguishing friendly soldiers from enemy combatants. One of the challenges facing soldiers in the field who employ heat detection devices such as infrared detectors is that the identity of a target is not readily discernible based on the mere existence of a heat signature. For example, animals, vehicles and random mechanical devices may all emit heat and, therefore, present themselves as a potential target. Without the right kind of target, heat detection device cannot differentiate between humans and other animals or things that emit heat.

A human body emits various levels of heat depending on the area of the body. For example, the top of the head emits less heat than the armpit region, and the chest area generally emits less heat than the top of the head but more heat than the armpit region. These variations in temperature can make the heat signature difficult to replicate in a target. In addition, heat signatures vary according to the ambient temperature. Although one would expect more heat to be emitted in higher ambient temperatures, certain regions of the body emit a disproportionately high amount of heat in higher temperatures. Accordingly, a human heat signature in one ambient temperature may vary significantly from an emitted heat signature in another temperature.

Although it is beneficial to train soldiers to detect human versus non-human heat signatures and to detect human heat signatures in various ambient temperatures, it is also critically important to train soldiers in differentiating one human heat signature from another. When a human is holding or carrying a weapon or other equipment, the resulting heat signature is characterized by a "cold spot" in the image corresponding to the location at which the body heat is blocked by the equipment. This characteristic in the heat signature is useful in identifying friendly versus enemy soldiers where the object causing the heat interference is specific to either the friendly or enemy soldier. For example, a soldier carrying an AK-47 or rocket-propelled grenade may be differentiated from U.S. or NATO soldiers who carry different weaponry and equipment.

Accordingly, it is an object of the present invention to provide a target with a thermal imaging system that emulates a human heat signature by allowing for different heat output in different heating zones. It is a further object of the present invention to provide a thermal imaging system in which the thermal output can be varied to accommodate different ambient temperatures. Lastly, it is an object of the present invention to provide a thermal imaging system that can be shot at numerous times and still continue to function. The present invention meets each of these objectives, as described more fully below.

BRIEF SUMMARY OF THE INVENTION

The present invention is a target with a thermal imaging system comprising a layer of corrugated plastic; a layer of bifurcated metallic foil; a layer of clear plastic; a wire grid; two strips of carbon tape; a front cover sheet; and a power lead with two first ends and a second end; wherein the layer of bifurcated metallic foil is situated on top of the layer of corrugated plastic; wherein the layer of clear plastic is situated on top of the layer of bifurcated metallic foil; wherein the wire grid is situated on top of the layer of clear plastic and comprises a right side and a left side; wherein one strip of carbon tape is adhered to the right side of the wire grid, and the other strip of carbon tape is adhered to the left side of the wire grid; wherein the front cover sheet is adhered to the target so that it covers the wire grid and carbon tape; and wherein the power lead comprises two first ends and a second end, each of the strips of carbon tape comprises a first end, one of the first ends of the power lead is connected to the first end of one of the carbon strips, the other first end of the power lead is connected to the first end of the other carbon strip, and the second end of the power lead is a connector plug.

In a preferred embodiment, the first ends of the power lead are comprised of tin, each first end of the power lead comprises teeth, and the teeth punch through the carbon tape and the layer of metallic foil when the first end of the power lead is connected to the first end of the carbon strip.

In a preferred embodiment, the present invention further comprises a hard plastic backing that is fastened to the corrugated plastic layer and that is used to secure the target in a target lift device. Preferably, the hard plastic backing is fastened to the corrugated plastic layer in a manner that allows the target to be bent vertically to fit into a target lift device. The layer of corrugated plastic preferably comprises an uppermost edge, and wherein a layer of caulk is applied to the uppermost edge of the layer of corrugated plastic.

In a preferred embodiment, the wire grid comprises a plurality of horizontal wires and a plurality of vertical wires, each horizontal wire comprises a first end and a second end, the first end of each horizontal wire comes into contact with one of the strips of carbon tape, the second end of each horizontal wire comes into contact with the other strip of carbon tape, and none of the vertical wires comes into contact with either of the strips of carbon tape. Preferably, the vertical wires are positioned on top of the horizontal wires. The vertical wires are preferably approximately one-half inch apart, and the vertical wires are preferably approximately one inch apart.

In a preferred embodiment, the wire grid is constructed so as to provide different heating zones within the target. Preferably, the different heating zones comprise a head zone, a shoulder zone, and a body zone, the wire grid comprises a plurality of horizontal wires and a plurality of vertical wires, each horizontal wire has a diameter, and the diameter of the horizontal wires differs among the heating zones. Preferably, the wire grid comprises a plurality of horizontal wires and a plurality of vertical wires, the horizontal wires are comprised of a nickel and chrome alloy, each horizontal wire has a diameter, the diameter of the horizontal wires in the head zone is roughly 0.0014 inches, the diameter of the horizontal wires in the shoulder zone is roughly 0.00175 inches, and the diameter of the horizontal wires in the body zone is roughly 0.002 inches. Preferably, the wire grid comprises a plurality of horizontal wires and a plurality of vertical wires, the vertical wires are comprised of a copper and nickel alloy, each vertical wire has a diameter, and the diameter of each vertical wire is roughly 0.004 inches.

In a preferred embodiment, the wire grid comprises a plurality of horizontal wires and a plurality of vertical wires, and the target further comprises a cap zone containing no horizontal wires and into which none of the vertical wires extends. Preferably, the wire grid comprises a plurality of horizontal wires and a plurality of vertical wires, the target has a front surface, and horizontal and vertical wires together comprise less than two percent of the front surface of the target.

In a preferred embodiment, the bifurcated foil layer comprises two outer edges, the first layer of clear plastic prevents the vertical wires from coming into contact with the bifurcated foil layer, and the first layer of clear plastic prevents the horizontal wires from coming into contact with the bifurcated foil layer other than at the outer edges of the bifurcated foil layer.

The present invention optionally comprises a silhouette accessory, wherein the silhouette accessory comprises at least one thermal block with a removable strip and an outer surface comprising an adhesive layer that allows the thermal block to be adhered to the front cover sheet.

REFERENCE NUMBERS

Figure 1:
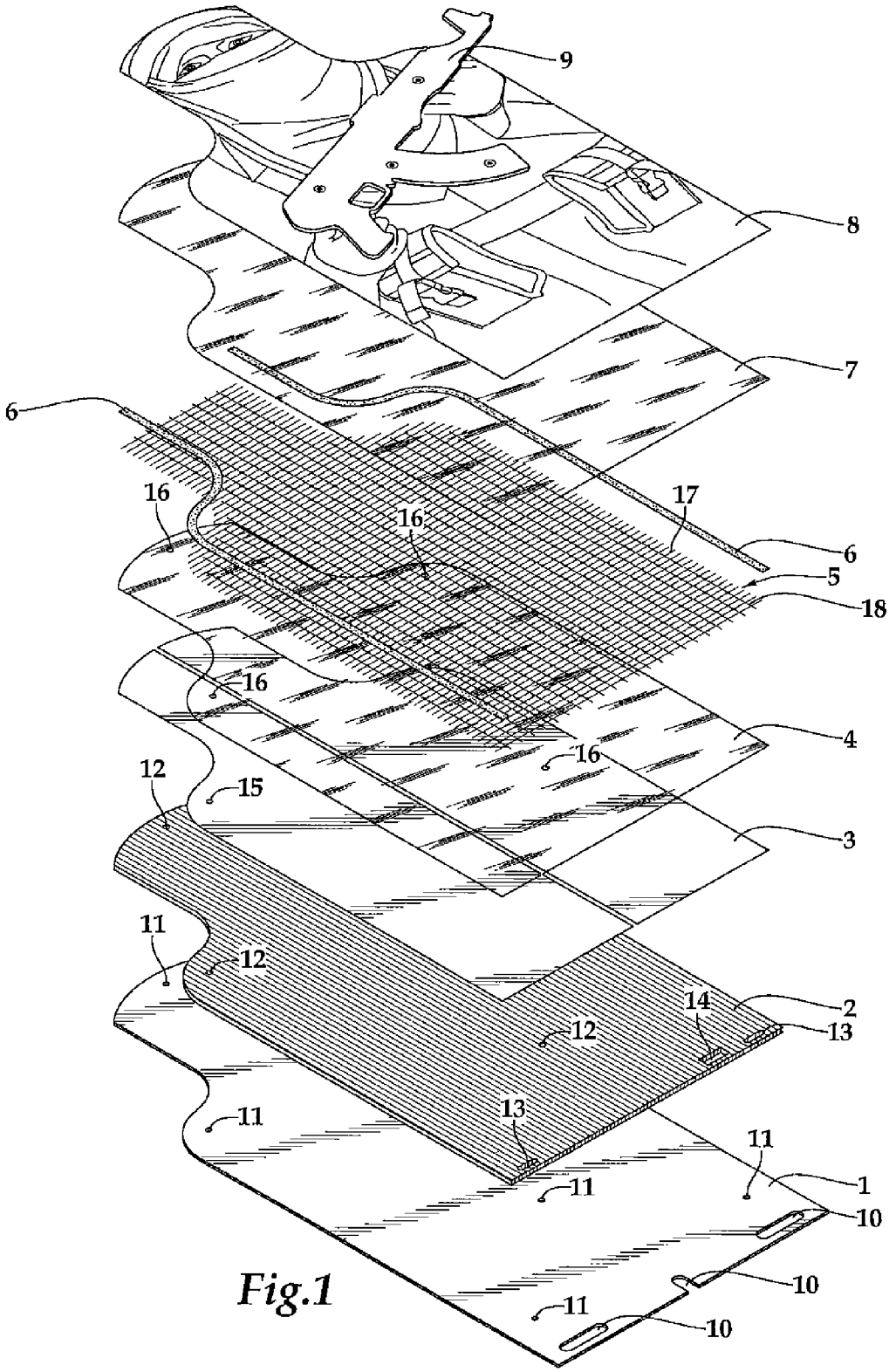
FIG. 1 is an exploded view of the present invention.

1 Hard plastic backing
2 Corrugated plastic layer
3 Bifurcated foil layer
4 First layer of clear plastic
5 Wire grid
6 Carbon tape
7 Second layer of clear plastic
8 Front cover sheet
9 Silhouette accessory
10 Cut-out (in hard plastic backing)
11 Aperture (in hard plastic backing)
12 Aperture (in corrugated plastic layer)
13 Cut-out (in corrugated plastic layer) for rivet
14 Cut-out (in corrugated plastic layer) for second end of power lead
15 Aperture (in bifurcated aluminum layer)
16 Aperture (in first clear plastic layer)
17 Horizontal wire
18 Vertical wire
19 Head zone
20 Body zone
21 Shoulder zone
22 Cap zone
23 First end of power lead
24 Second end of power lead
25 First rivet
26 Spacer component
27 Second rivet
28 Rivet backing
29 Silhouette accessory
30 Thermal block
31 Removable strip
32 Outer adhesive surface (of thermal block)
33 Power lead

DETAILED DESCRIPTION OF INVENTION

FIG. 1 is an exploded view of the present invention. As shown in this figure, the present invention comprises a hard plastic backing 1, a corrugated plastic layer 2, a bifurcated layer of metallic foil 3 (preferably aluminum), a first layer of clear plastic 4, a wire grid 5, two strips of carbon tape 6, and a second layer of clear plastic 7 that is used only during the manufacturing process and removed prior to installation of the front cover sheet 8. (As used in the claims, the term "clear plastic layer" refers to the first clear plastic layer 4 because the second clear plastic layer 7 is not part of the final product.) The carbon tape 6 used in the present invention is preferably a carbon-filled electrically conductive adhesive strip (i.e., nonwoven carbon paper that is saturated with adhesive). The present invention further comprises a front cover sheet 8 and optional silhouette accessory 9.

The hard plastic backing 1 is used to secure the target in a target lift device, such as those currently in use by the military. In a preferred embodiment, the hard plastic backing 1 also provides sufficient mechanical resistance so that when the target is hit (shot at), the target lifter will cause the target to fall down. Without a backing made of hard plastic or similarly mechanically resistant material, the target will heat as intended, but it will not fall down when hit. Thus, although some type of backing is needed to secure the target to the target lift device, a hard plastic backing 1 is preferred for those applications in which it is important to cause the target to fall down when hit.

The hard plastic backing 1 preferably comprises one or more cut-outs 10 that allow the hard plastic backing 1 to be secured to a target lift device. The exact size and shape of these cut-outs 10 will depend on the target lift device to which the hard plastic backing 1 is secured. Some target device may not require any cut-outs at all. The present invention is not limited to any particular shape, size or number of cut-outs 10, or any cut-outs at all, in the hard plastic backing 1. The hard plastic backing 1 also comprises a plurality of apertures 11 that are used to secure the hard plastic backing 1 to the corrugated plastic layer 2, as described more fully below.

Figure 4A:
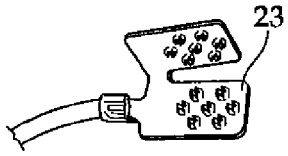
FIG. 4A is a detail view of a first end of the power lead of the present invention.

The corrugated plastic layer 2 is a non-conductive layer that serves as the template upon which the wire grid 5 is supported. As shown in FIG. 1, the corrugations in this layer preferably run vertically. The corrugated plastic layer 2 preferably comprises two cut-outs 13 that are used to secure the corrugated plastic layer 2 to the hard plastic backing 1. In a preferred embodiment, the corrugated plastic layer 2 also comprises a cut-out 14 that is used to stow one end of the power lead when the power lead is not in use (see FIG. 4D).

All of the layers shown in FIG. 1 are in the shape of a human target. The corrugated plastic layer 2 is preferably the same size as the hard plastic backing 1, except that the hard plastic backing 1 is longer (at the bottom) than the corrugated plastic layer 2. In a preferred embodiment, the corrugated plastic layer 2 comprises a layer of caulk (not shown) on the uppermost edge of the corrugated plastic layer 2. The purpose of the caulk is two-fold: (i) to prevent water or other precipitation and/or debris from entering the corrugated plastic layer 2 and (ii) to prevent heat from escaping from inside of the corrugated plastic layer 2 into the atmosphere.

The bifurcated foil layer 3 is electrically conductive, and it is bifurcated to prevent short circuits from occurring when the wire grid 5 is energized. The bifurcated foil layer 3 is preferably slightly shorter and narrower than the corrugated plastic layer 2. The bifurcated foil layer 3 also comprises apertures 15 for securing the corrugated plastic layer 2 (and the other layers that rest on top of it, namely, the bifurcated foil layer 3, the first clear plastic layer 4, the wire grid 5, and the carbon tape 6) to the hard plastic backing 1. The bifurcated foil layer 3 preferably comprises an adhesive on either side (back and front) so as to facilitate adhesion to the corrugated plastic layer 2 and the first clear plastic layer 4.

The next layer after the bifurcated foil layer 3 is the first clear plastic layer 4. This layer is roughly the same size as the bifurcated foil layer 3, except that it is not bifurcated. The first clear plastic layer 4 is preferably the same length as the bifurcated foil layer 2 but slightly narrower than the bifurcated foil layer 2. The purpose of the first clear plastic layer is to prevent the wire grid 5 from touching the bifurcated foil layer 3 other than at the outer vertical edges of the bifurcated foil layer 3. The first clear plastic layer 4 preferably comprises an adhesive on both sides (back and front) so as to facilitate adhesion of the first clear plastic layer 4 to the bifurcated foil layer 3 and the wire grid 5 to the first clear plastic layer 4. The first clear plastic layer 4 comprises apertures 16 that are used to secure the corrugated plastic layer (and the other layers on top of it) to the hard plastic backing 1.

The next layer is the wire grid 5. This layer comprises a plurality of horizontal wires 17 and a plurality of vertical wires 18. The horizontal wires 17 extend beyond the edge of the first clear plastic layer 4 so that they come into contact with the bifurcated foil layer 3. The vertical wires 18 end short of the clear plastic layer 4 so that they do not come into contact with the bifurcated foil layer 3 at all. As discussed more fully below, the purpose of the wire grid 5 is to conduct electricity across the surface of the target when the carbon tape 6 is energized.

The carbon tape 6 preferably runs from the bottom of the target to the top, along the outer edges of the target. As discussed in connection with FIG. 3, each strip of carbon tape 6 is connected to a power lead 33. When voltage is applied to the power lead 33, electricity is conducted along the carbon tape 6, which is in contact with the outer ends of the horizontal wires 17 of the wire grid 5. In this manner, the wire grid 5 is energized. Because the carbon tape 6 and the horizontal wires 17 of the wire grid 5 are also in contact with the bifurcated foil layer 3, both halves of the aluminum foil layer serve to spread the heat out across the surface of the target without leaving gaps between wires.

In a preferred embodiment, the corrugated plastic layer 2 is secured to the hard plastic backing 1 with rivets (see FIG. 7B) and the first ends 23 of the power lead 33 attached to the carbon tape 6 (see FIG. 3) before the next layer is applied. The next layer is a second clear plastic layer 7; as noted above, this layer is used only during the manufacturing process and is removed prior to installation of the front cover sheet 8. This layer is the same length as the aluminum foil layer, and in one embodiment, the second clear plastic layer is roughly as wide as the first clear plastic layer 4. Thus, a portion of the carbon tape 6 extends beyond the second clear plastic layer 7, but this is not necessary for any functional reason (it may simply be easier from a manufacturing standpoint to cut the first and second clear plastic layers so that they are the same size). The second clear plastic layer 7 could be the same width as the bifurcated foil layer 3. The second clear plastic layer 7 is preferably non-adhesive on either side, and it is secured in place by the adhesive on the first clear plastic layer 4. The purpose of the second clear plastic layer 7 is to prevent debris from sticking to the assembly (including the first clear plastic layer 4 and the carbon tape 6) during handling and/or storage.

The next layer is the front cover sheet 8. The front cover sheet 8 is preferably comprised of vinyl with an adhesive on one side that allows the front cover sheet 8 to be adhered to the assembly (the "assembly" being the corrugated plastic layer 2, the bifurcated foil layer 3, the first clear plastic layer 4, the wire grid 5, and the carbon tape 6 but excluding the second clear plastic layer 7). The front cover sheet 8 may comprise an image of a friendly soldier, an enemy combatant, or it may be a solid color. The front cover sheet 8 allows the target to be used to provide an image for visual non-assisted (non-thermal) identification.

An optional silhouette accessory 9 may be adhered to the front cover sheet 8 (see FIG. 10) of the target. The purpose of the silhouette accessory 9 is to create a silhouette of a weapon or other piece of equipment within the heat signature created by the target. Although the silhouette accessory is depicted in the figures as an AK47 assault rifle, it could be in the shape of any other weapon or piece of equipment typically carried by soldiers or combatants. In this manner, soldiers can be trained to recognize friendly soldiers or enemy combatants based on the silhouettes of their weapons and/or equipment within their respective heat signatures.

Figure 2:
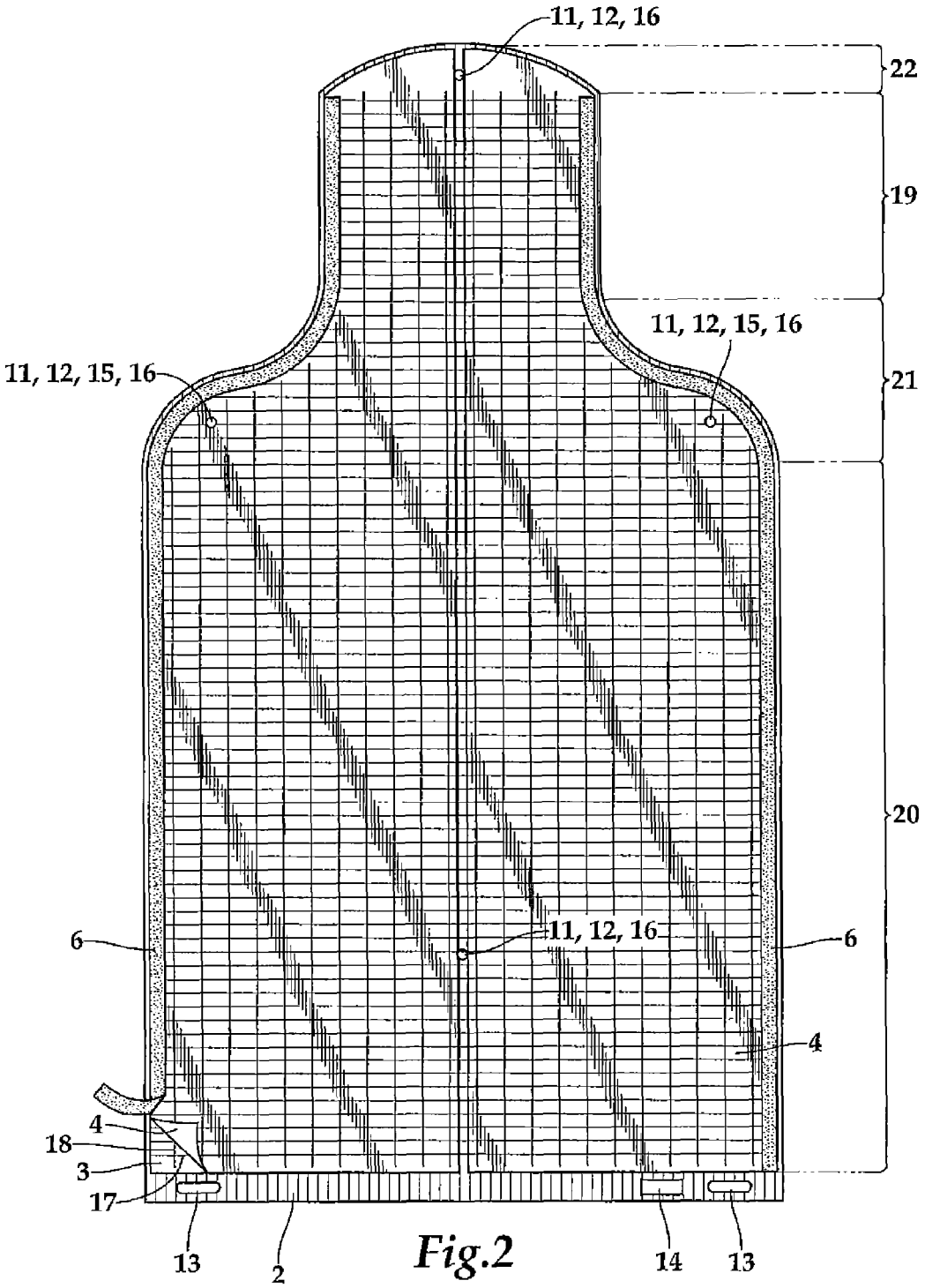
FIG. 2 is a front view of the present invention with the target assembled but without the hard plastic backing or front cover sheet.

FIG. 2 is a front view of the present invention with the target assembled but without the hard plastic backing or front cover sheet. This figure shows the apertures 11, 12, 15 and 16 that allow the corrugated plastic layer 2 is be secured to the hard plastic backing 1. It also shows the wire grid 5, which is comprised of a plurality of horizontal wires 17 disposed parallel to one another and a plurality of vertical wires 18 disposed parallel to one another. In a preferred embodiment, the vertical wires 18 are positioned on top of the horizontal wires 17 so that the horizontal wires 17 are closest to the bifurcated foil layer 3. In a preferred embodiment, the horizontal wires 17 are approximately one-half inch apart, and the vertical wires 18 are approximately one inch apart. Preferably, the vertical wires 18 of the wire grid 5 never touch the carbon tape 6. As noted above, the horizontal wires 17, on the other hand, come into contact with the carbon tape 6 and the outer edges of the bifurcated foil layer 3.

In a preferred embodiment, the wire grid 5 is constructed so as to provide different heating zones within the target. As is known in the art, the electrical resistance of a wire is affected by the wire's diameter, length, and the type of metal or metal alloy used to fabricate the wire. In the present invention, the length of horizontal wire 17 is dictated by the shape of the target. The diameter, however, can be adjusted. In a preferred embodiment, the wire grid 5 comprises a head zone 19, a body zone 20, and a shoulder zone 21. In a preferred embodiment, the target further comprises a cap zone 22 that contains no horizontal wires and to which none of the vertical wires extends.

In a preferred embodiment, all of the horizontal wires 17 are preferably comprised of the same metal alloy, namely, an alloy of nickel and chrome. One such alloy is NIKROTHAL 60™ manufactured by Sandvik AB of Sandviken, Sweden. In a preferred embodiment, the horizontal wires of the head zone 20 are 47 gauge (0.0014 inches in diameter), the horizontal wires of the shoulder zone 22 are 45 gauge (0.00175 inches in diameter), and the horizontal wires of the body zone 21 are 44 gauge (0.002 inches in diameter). By adjusting the diameter of the wires in the head, shoulder and body zones in relation to the length of the wires, a target is provided that will emit greater heat in the head area, less heat in the body area, and still less heat in the shoulder area. No heat is emitted in the cap area.

The vertical wires 18 preferably have a greater diameter than all of the horizontal wires 17 so that they will conduct electricity without heating up (i.e., they are preferably less resistant than the horizontal wires 17). In a preferred embodiment, the vertical wires 18 are 38 gauge (0.004 inches in diameter), and they are comprised of an alloy of copper and nickel. One such alloy is CUPROTHAL 49™ manufactured by Sandvik AB of Sandviken, Sweden. The vertical wires are not connected to a power source, and their only function is to provide a path around a broken horizontal wire.

In a preferred embodiment, the wires 17, 18 that comprise the wire grid 5 comprise less than two percent (2%) of the entire front surface of the target. The wire grid 5 is constructed to provide maximum survivability to the target. In tests involving the present invention, the target was hit by 1600 bullets and still continued functioning. The reason the target is able to survive this many hits is because if a horizontal wire is broken, the electrical current may travel up one of the vertical wires and across an adjacent horizontal wire. The only way the target would become completely dysfunctional is if all (or a significant portion) of the horizontal wires were broken at the point at which they cross from one half of the bifurcated foil layer 3 to the other. The odds of that happening are virtually nil.

Figure 3:
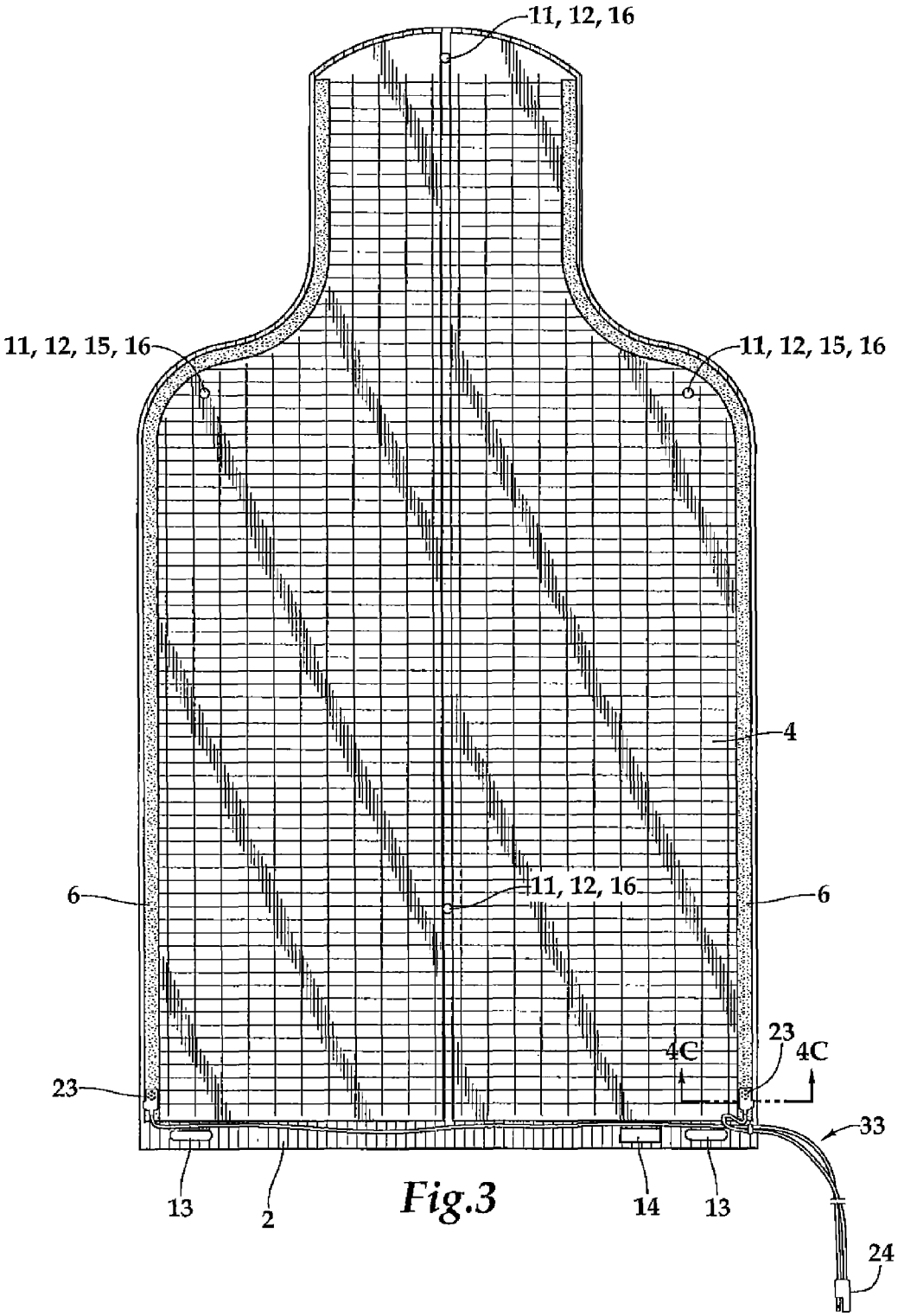
FIG. 3 is a front view of the present invention with the target assembled but without the hard plastic backing or front cover sheet and with the power lead installed on the target.

FIG. 3 is a front view of the present invention with the target assembled but without the hard plastic backing or front cover sheet and with the power lead 33 installed on the target. This figure is the same as FIG. 2, except that it shows the power lead 33 attached to the bottom end of each strip of carbon tape 6. In a preferred embodiment, the power lead 33 comprises two first ends 23 (see FIG. 4A), each of which is crimped around the bottom end of the carbon tape. The first end 23 of the power lead 33 is preferably comprised of tin so that it will not react with the aluminum foil. The first end 23 preferably comprises teeth (shown in FIG. 4A) that punch through the aluminum foil. The second end 24 of the power lead 33 (see FIG. 4B) is preferably stowed in the cut-out 14 in the corrugated plastic layer 2 when not in use (see FIG. 4D). The second end 24 is a connector plug that connects to a power source. The power source may be any electrical power device, such as a battery or transformer, and the power can be alternating current (AC) or direct current (DC). The transformer may be used in connection with a controller that allows the voltage flowing to the wire grid to be adjusted. In a preferred embodiment, the voltage input does not exceed 24 volts.

Figure 4C:
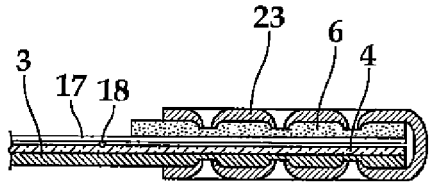
FIG. 4C is a section view of the power lead installed on the target.
Figure 4B:
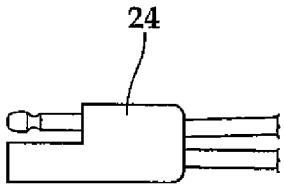
FIG. 4B is a detail view of a second end of the power lead of the present invention.
Figure 4D:
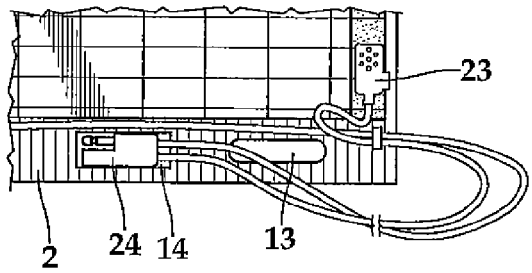
FIG. 4D is a detail view of the second end of the power lead secured in a cut-out in the corrugated plastic layer.

FIG. 4C shows the first end 23 of the power lead 33, the carbon tape 6, the horizontal wire(s) 17, the first clear plastic layer 4, and one half of the bifurcated foil layer 3. As shown in FIG. 3, the power lead 33 preferably comprises two first ends 23 and one second end 24. One of the first ends (in this case, shown on the right-hand side of the figure) provides voltage to the wire grid, and the other first end (case, shown on the left-hand side of the figure) allows for voltage to flow out of the wire grid, thereby completing the circuit. The fact that the horizontal wires 17 extend all the way across the front surface of the target and come into contact with each of the strips of carbon tape 6 allows the electrical circuit to be completed.

Figure 5:
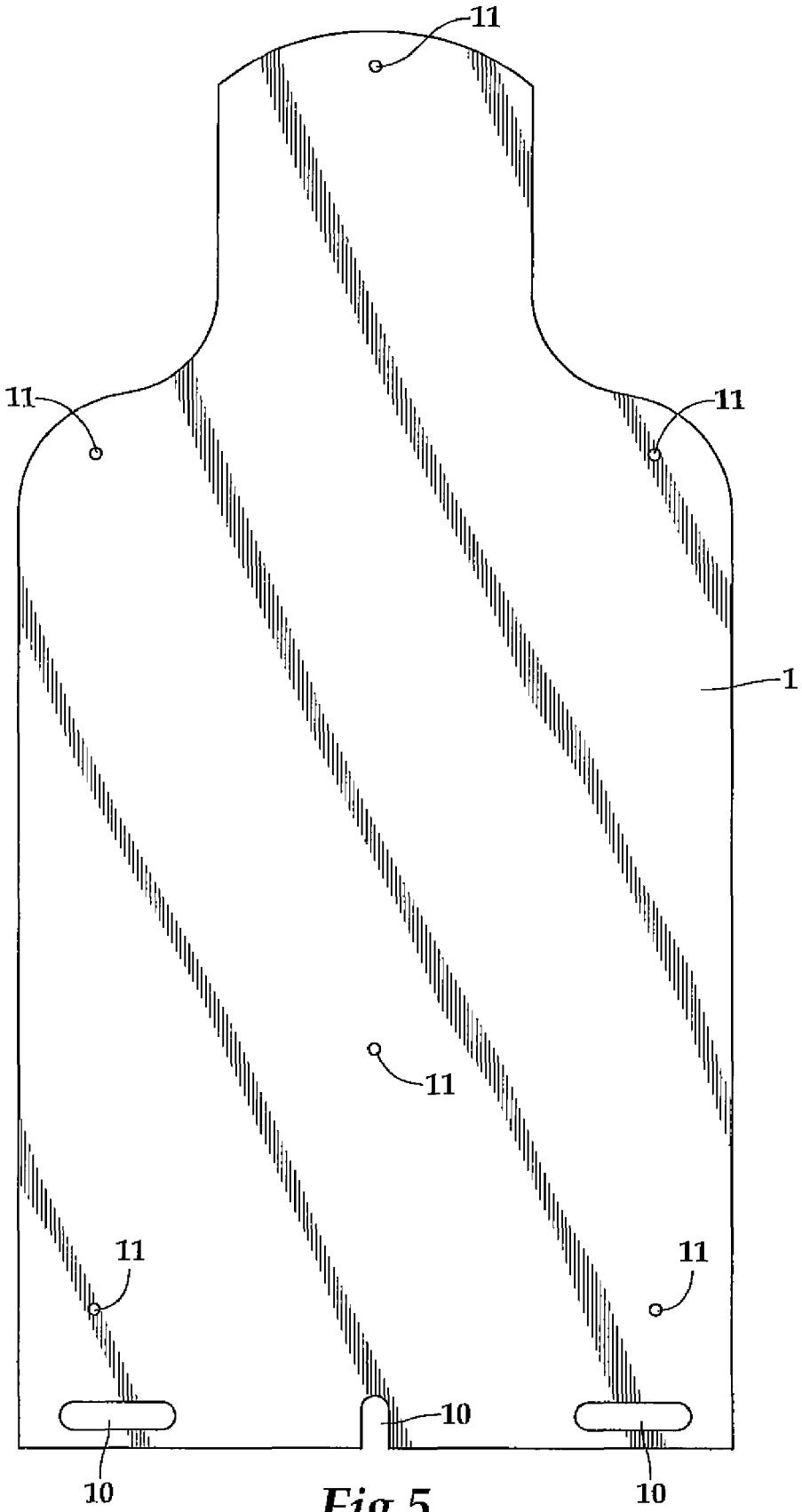
FIG. 5 is a front view of the hard plastic backing of the present invention.

FIG. 5 is a front view of the hard plastic backing of the present invention. The purpose of the hard plastic backing 1 was discussed in connection with FIG. 1.

Figure 7A:
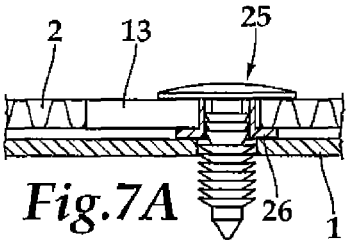
FIG. 7A is a detail view of a first rivet used to attach the corrugated plastic layer to the hard plastic backing.
Figure 6:
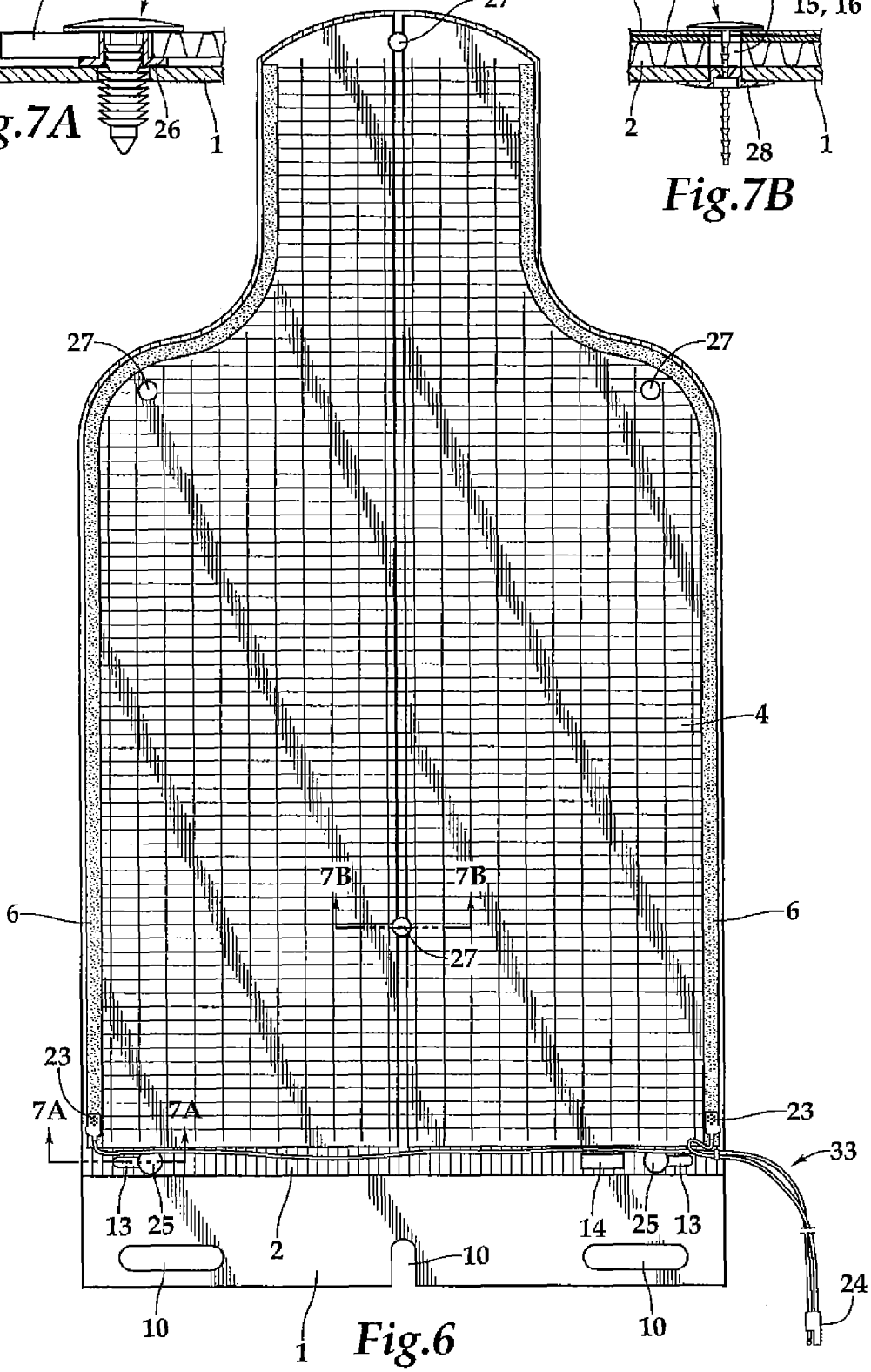
FIG. 6 is a front view of the present invention with the hard plastic backing but without the front cover sheet.

FIG. 6 is a front view of the present invention with the hard plastic backing but without the front cover sheet. This figure illustrates one method of attaching the corrugated plastic layer 2 to the hard plastic backing 1, but the present invention is not limited to any particular method of attachment. In this example, first rivets 25 (see FIG. 7A) extend through the cut-outs 13 in the corrugated plastic layer 2 and through the hard plastic backing 1. A separate spacer component 26 encircles the shaft of the rivet and is situated between the corrugated plastic layer 2 and the hard plastic backing 1. The purpose of the spacer component 26 is to allow the first rivet 25 to slide laterally (right to left and vice versa) within the cut-out 13. This lateral movement is necessary so that the target can be bent vertically (i.e., curved slightly to resemble a three-dimensional figure) to fit into a target lift device. As the target is bent, the first rivets 25 move slightly to the right within the cut-outs 13.

Figure 7B:
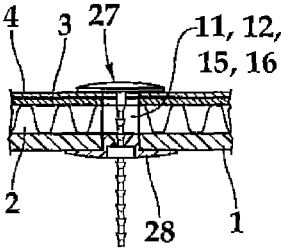
FIG. 7B is a detail view of a second rivet used to attach the corrugated plastic layer to the hard plastic backing.

Second rivets 27 and rivet backings 28 are used to secure the plastic corrugated layer 2 to the hard plastic backing 1 at apertures 11, 12, 15 and 16. As shown in FIG. 7B, the second rivet 27 extends through the first clear plastic layer 4, the bifurcated aluminum foil, if applicable (the two second rivets located on the central axis of the target do not actually extend through the aluminum foil but through the space between the two halves of the foil), the corrugated plastic layer 2 and the hard plastic backing 1.

Figure 8:
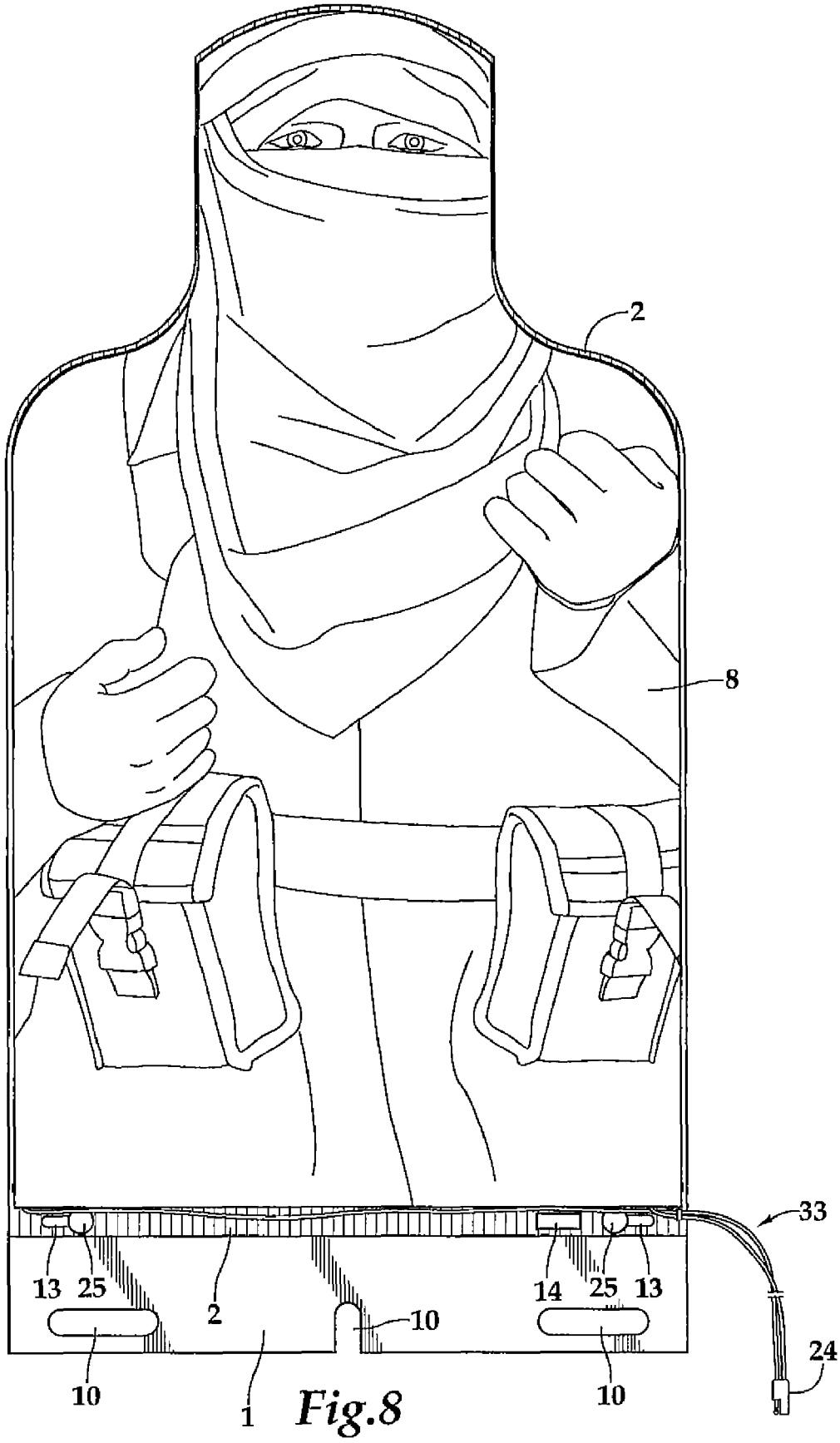
FIG. 8 is a front view of the present invention with the hard plastic backing and the front cover sheet.

FIG. 8 is a front view of the present invention with the hard plastic backing and the front cover sheet. As noted above, the front cover sheet 8 is simply adhered to the assembly.

Figure 9:
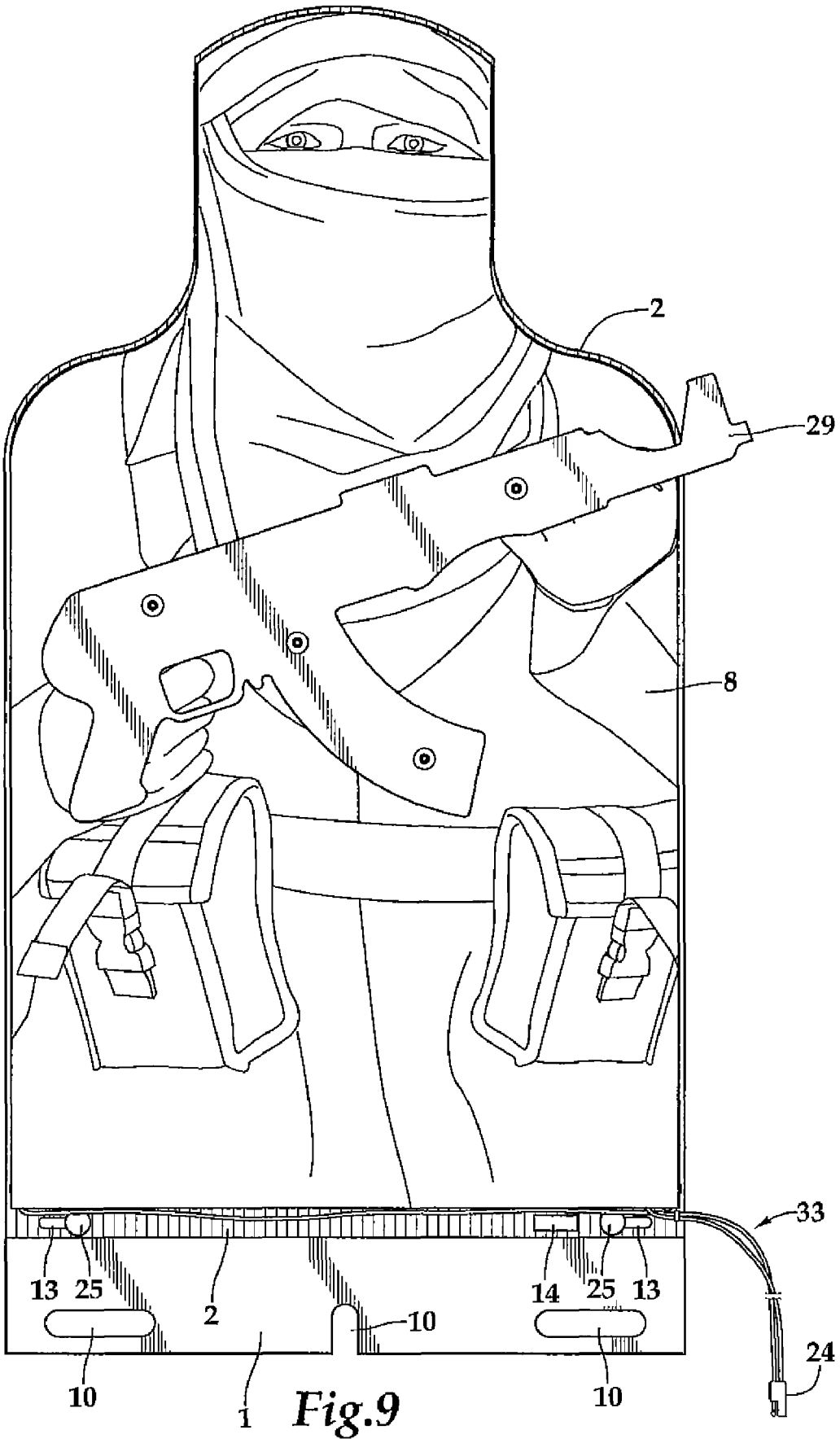
FIG. 9 is a front view of the present invention with the hard plastic backing, the front cover sheet, and a silhouette accessory.

FIG. 9 is a front view of the present invention with the hard plastic backing, the front cover sheet, and a silhouette accessory. The silhouette accessory 29 creates a silhouette in the shape of the silhouette accessory 29 within the heat signature of the target. (As used herein, the term "heat signature" refers to the heat pattern that is created by the target or by an animate or inanimate object.) The purpose of the silhouette accessory is described above in connection with FIG. 1.

Figure 10:
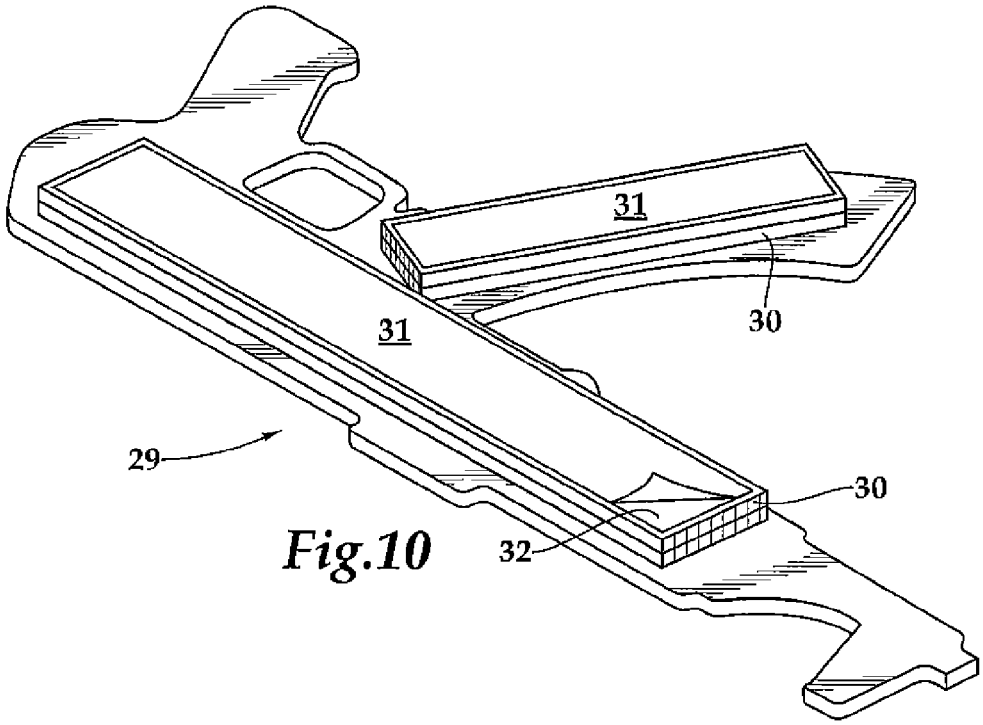
FIG. 10 is a perspective view of the silhouette accessory.

FIG. 10 is a perspective view of the silhouette accessory. As shown in this figure, the silhouette accessory 29 preferably comprises one or more thermal blocks 30 that allow the silhouette accessory 29 to be adhered to the front of the target and that provide a heat barrier between the silhouette and the target. Each thermal block preferably comprises a removable strip 31 that exposes an outer surface 32 of the thermal block 30. The outer surface 32 of the thermal block 30 preferably comprises an adhesive layer that allows the block 30 to be adhered to the front cover sheet 8.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A target with a thermal imaging system comprising:

(a) a layer of corrugated plastic;

(b) a layer of bifurcated metallic foil;

(c) a layer of clear plastic;

(d) a wire grid;

(e) two strips of carbon tape;

(f) a front cover sheet; and (g) a power lead with two first ends and a second end;

wherein the layer of bifurcated metallic foil is situated on top of the layer of corrugated plastic;

wherein the layer of clear plastic is situated on top of the layer of bifurcated metallic foil;

wherein the wire grid is situated on top of the layer of clear plastic and comprises a right side and a left side;

wherein one strip of carbon tape is adhered to the right side of the wire grid, and the other strip of carbon tape is adhered to the left side of the wire grid;

wherein the front cover sheet is adhered to the target so that it covers the wire grid and carbon tape; and wherein the power lead comprises two first ends and a second end, each of the strips of carbon tape comprises a first end, one of the first ends of the power lead is connected to the first end of one of the carbon strips, the other first end of the power lead is connected to the first end of the other carbon strip, and the second end of the power lead is a connector plug.

2. The target of claim 1, wherein the first ends of the power lead are comprised of tin, wherein each first end of the power lead comprises teeth, and wherein the teeth punch through the carbon tape and the layer of metallic foil when the first end of the power lead is connected to the first end of the carbon strip.

3. The target of claim 1, further comprising a hard plastic backing that is fastened to the corrugated plastic layer and that is used to secure the target in a target lift device.

4. The target of claim 3, wherein the hard plastic backing is fastened to the corrugated plastic layer in a manner that allows the target to be bent vertically to fit into a target lift device.

5. The target of claim 1, wherein the layer of corrugated plastic comprises an uppermost edge, and wherein a layer of caulk is applied to the uppermost edge of the layer of corrugated plastic.

6. The target of claim 1, wherein the wire grid comprises a plurality of horizontal wires and a plurality of vertical wires; wherein each horizontal wire comprises a first end and a second end; wherein the first end of each horizontal wire comes into contact with one of the strips of carbon tape, and the second end of each horizontal wire comes into contact with the other strip of carbon tape; and wherein none of the vertical wires comes into contact with either of the strips of carbon tape.

7. The target of claim 6, wherein the vertical wires are positioned on top of the horizontal wires.

8. The target of claim 6, wherein the vertical wires are approximately one-half inch apart, and the vertical wires are approximately one inch apart.

9. The target of claim 1, wherein the wire grid is constructed so as to provide different heating zones within the target.

10. The target of claim 9, wherein the different heating zones comprise a head zone, a shoulder zone, and a body zone, wherein the wire grid comprises a plurality of horizontal wires and a plurality of vertical wires, wherein each horizontal wire has a diameter, and wherein the diameter of the horizontal wires differs among the heating zones.

11. The target of claim 1, wherein the wire grid comprises a plurality of horizontal wires and a plurality of vertical wires, wherein the horizontal wires are comprised of a nickel and chrome alloy, wherein each horizontal wire has a diameter, wherein the diameter of the horizontal wires in the head zone is roughly 0.0014 inches, wherein the diameter of the horizontal wires in the shoulder zone is roughly 0.00175 inches, and wherein the diameter of the horizontal wires in the body zone is roughly 0.002 inches.

12. The target of claim 1, wherein the wire grid comprises a plurality of horizontal wires and a plurality of vertical wires, wherein the vertical wires are comprised of a copper and nickel alloy, wherein each vertical wire has a diameter, and wherein the diameter of each vertical wire is roughly 0.004 inches.

13. The target of claim 1, wherein the wire grid comprises a plurality of horizontal wires and a plurality of vertical wires, and wherein the target further comprises a cap zone containing no horizontal wires and into which none of the vertical wires extends.

14. The target of claim 1, wherein the wire grid comprises a plurality of horizontal wires and a plurality of vertical wires, wherein the target has a front surface, and wherein horizontal and vertical wires together comprise less than two percent of the front surface of the target.

15. The target of claim 1, wherein the bifurcated foil layer comprises two outer edges, wherein the first layer of clear plastic prevents the vertical wires from coming into contact with the bifurcated foil layer, and wherein the first layer of clear plastic prevents the horizontal wires from coming into contact with the bifurcated foil layer other than at the outer edges of the bifurcated foil layer.

16. The target of claim 1, further comprising a silhouette accessory, wherein the silhouette accessory comprises at least one thermal block with a removable strip and an outer surface comprising an adhesive layer that allows the thermal block to be adhered to the front cover sheet.

* * * * *